US005595306A

United States Patent [19]

Hukki et al.

[11] Patent Number: 5,595,306

[45] Date of Patent: Jan. 21, 1997

[54] SCREENING SYSTEM

[75] Inventors: Ari M. Hukki, Edgewood; Brian S. Carr, Ft. Wright, both of Ky.

[73] Assignee: Emerson Electric Co., St. Louis, Mo.

[21] Appl. No.: 447,272

[22] Filed: May 22, 1995

[51] Int. Cl.[6] ..... B07B 1/34

[52] U.S. Cl. ..... 209/325; 209/326; 209/331; 209/365.4; 209/364; 209/405; 209/411; 209/412

[58] Field of Search ..... 209/325, 326, 209/327, 329, 331, 332, 333, 341, 346, 365.4, 366, 366.5, 367, 364, 405, 408, 411, 412

[56] References Cited

U.S. PATENT DOCUMENTS

| | | | |
|---|---|---|---|
| 2,880,871 | 4/1959 | Bruninghaus | 209/310 |
| 2,950,819 | 8/1960 | Holman et al. | 209/326 |
| 3,049,235 | 8/1962 | Newburg | 209/346 |
| 3,478,406 | 11/1969 | Auckland | 209/366.5 X |
| 3,490,584 | 1/1970 | Balamuth | 209/1 |
| 3,650,401 | 3/1972 | Riesbeck et al. | 209/325 |
| 3,954,604 | 5/1976 | Krause et al. | 209/325 |
| 4,062,768 | 12/1977 | Elliott | 209/341 |
| 4,274,953 | 6/1981 | Jackson | 209/326 |
| 4,482,455 | 11/1984 | Humphrey | 209/319 |
| 4,728,422 | 3/1988 | Bailey | 209/403 X |
| 4,816,144 | 3/1989 | Monteith | 209/364 |
| 5,143,222 | 9/1992 | Monteith | 209/364 |
| 5,221,008 | 6/1993 | Derrick, Jr. et al. | 209/403 X |
| 5,265,730 | 11/1993 | Norris et al. | 209/326 |
| 5,386,169 | 1/1995 | Dubruque | 310/323 |
| 5,398,816 | 3/1995 | Senapati | 209/364 |

FOREIGN PATENT DOCUMENTS

| | | |
|---|---|---|
| 2682050 | 4/1993 | France . |
| 1094218 | 12/1967 | United Kingdom . |
| 1425924 | 1/1976 | United Kingdom . |
| 1462866 | 1/1977 | United Kingdom . |
| WO94/27748 | 12/1994 | WIPO . |

OTHER PUBLICATIONS

Brochure of Sodeva, Published Mar. 1993 (2 pgs.)

*Primary Examiner*—David H. Bollinger
*Attorney, Agent, or Firm*—Lyon & Lyon

[57] ABSTRACT

A screening system having a resiliently mounted housing with a screen extending thereacross. The housing is vibrated by a low frequency vibratory drive using eccentric weights. About the peripheral frame of the screen, a high frequency drive or drives is employed to vibrate the screen in the range of 20,000 Hz. The high frequency vibration is generated at the peripheral frame about the screen. The screen may be responsive to the high frequency vibrations in a plate-like manner or as a membrane. With the high frequency drives mounted within the housing, a structure made of a sheet extends from a mounting flange inwardly to a mounting ring supporting the screen and the high frequency drives and inwardly to a collecting system including a trough and a central dome. The center of the dome may be fixed to the screen and include a high frequency drive.

37 Claims, 9 Drawing Sheets

SCREENING SYSTEM

BACKGROUND OF THE INVENTION

The field of the present invention is screening systems including the use of both low and high frequency vibration.

Traditional vibratory screening structures typically include a base, a housing resiliently mounted on the base with a screen or screens extending across the housing, a dome beneath the screen to direct the screened material to the periphery of the housing and outlet ports above and below the screen for oversized and screened particles, respectively. A low frequency vibratory drive in the speed range of 8 Hz to 30 Hz is mounted to the housing and drives eccentric weights. Specific vibratory motions are established in the housing by the low frequency vibratory drive, generating screen accelerations up to the 7 g range.

The foregoing devices have been used for screening all sizes of materials and powders. For fine materials and powers, stainless steel woven mesh screens having interstices in the 30 to 150 micron range are used for commercial processing. These delicate, woven meshes are thin and comparatively limp. The mesh is usually stretched tightly and attached to a screen frame. The vibration of such devices typically enhances gravity separation of particles presented to the screen. Where fine particles are to be screened, the vibration also can have a deleterious effect in that the fine particles become suspended above a boundary layer over the vibrating screen.

In an effort to overcome the deficiency of low frequency vibration, high frequency vibration has been employed. Ultrasonic vibrators such as magnetostrictive ultrasonic transducers have been mounted to separator housings, to peripheral screen frames and directly to screens at the centers thereof. Multiple such ultrasonic vibrators have been employed for better energy distribution. FIGS. 1 through 5 represent devices preceding the present invention.

FIG. 1 illustrates a prior vibratory screen separator. The separator includes a base 10 resiliently mounting a separator housing 12 by means of springs 14. The separator housing 12 is illustrated here to be cylindrical, open at the top to receive material input and having discharge ports 16 and 18 for the screened material and the oversize material, respectively. A low frequency vibratory drive 20 is rigidly fixed to the separator housing 12. The drive 20 includes upper and lower eccentric weights 22 and 24 to generate a vibratory motion when rotatably driven.

A screen 26 extends across the separator housing 12 such that material input above the screen 26 must either pass through the screen or through the oversize discharge port 18. The screen 26 includes a screening element 28 stretched in tension uniformly by a screen frame 30. The screening element 28 is a composite of a fine mesh screen of a desired size with a stiffer porous sheet, most conveniently a perforated plate. Diffusion bonding is employed across the full area of the screening element 28. Such bonded screening elements are commercially available.

To bond fine mesh screen cloth to a perforated plate with diffusion bonding, it is preferable to include a coarse mesh screen cloth therebetween. A fine mesh screen 32, a coarse mesh screen 34 and a perforated plate 36 are shown. These are supplied as a diffusion bonded laminate which is tensioned and bonded to a screen frame 30 to form the screen structure 26. The fine mesh screen cloth may be dictated by the requirements of the materials being screened. 200 mesh and 325 mesh screen cloth is common. The backing perforated plate is preferably 80% open and is from 1/16" to 3/16" thick. Design choice may dictate thinner or thicker plates depending on separator size, weight of material, degree of low frequency vibrations and the like.

As illustrated in FIGS. 2 through 5, two types of screen mountings have been employed. In FIGS. 2 and 3, the separator housing 12 directly supports the screen 26. The high frequency generator 38 is shown to be mounted rigidly to the separator housing 12 by a fixed bracket 40. The action of the high frequency generator or generators 38 through the fixed bracket or brackets 40 on the separator housing 12 is transferred from that peripheral housing to the screen 26. The separator housing 12 in its entirety is also subject to be vibrated in this arrangement.

An alternative arrangement is illustrated in FIGS. 4 and 5. In these Figures, resilient elements or gaskets 42 and 44 are positioned on top and bottom of the screen frame 30 to isolate the screen frame from the surrounding separator housing 12. The resilient elements would act to isolate the separator housing 12 but would also act to damp some of the power generated by the generator(s) 38. Again, the vibration is introduced by means of a peripheral frame to the screen 26.

Low frequency vibration is employed at levels allowing the separator housing 12 and screen 26 to vibrate as a rigid body, even in the embodiment where the resilient elements 42 and 44 are employed. Smaller power and lighter weights may be employed for the low frequency vibratory drive as compared with conventional low frequency separators since this drive is now relegated to transportation of material across the screen. Low frequency vibrations effective for conveying material are typically considered most effective in the 3 Hz to 30 Hz range. Energy typically effective for conveyance of fine material on a screen may be measured in screen acceleration in the ½ g to 4 g range at 20 Hz.

SUMMARY OF THE INVENTION

The present invention is directed to screening systems using high frequency drives mounted to drive through isolated structure. Substantial energy can be transmitted across a wide area of screen while fatigue failure of the screen at the boundary with the ultrasonic attachment is reduced or eliminated.

In one, separate aspect of the present invention, a screening system having a resiliently mounted housing includes a screen extending across the housing and supported by a thin-walled sheet which has a mounting flange extending to the housing. At least one high frequency drive is mounted rigidly to the periphery of the screen with the drive positioned below the sheet.

In another, separate aspect of the present invention, the foregoing screening system includes a wall to isolate the at least one high frequency drive from the material processed through the screen and yet allow coupling of the drive or drives to the screen frame for ultrasonic excitation of the screen element.

In a further, separate aspect of the present invention, a trough and central dome may be also associated with the wall. Depending on the structure of the wall, selected isolation of ultrasonic vibration, protection of the drives and structural support can be provided for the system.

Thus, improved multiple frequency vibrational screening is achieved. Other objects and advantages will appear hereinafter.

BRIEF DESCRIPTION OF THE DRAWINGS

FIG. 7 is a detail of the left portion of FIG. 6.

DETAILED DESCRIPTION OF THE PREFERRED EMBODIMENTS

Figure 1:
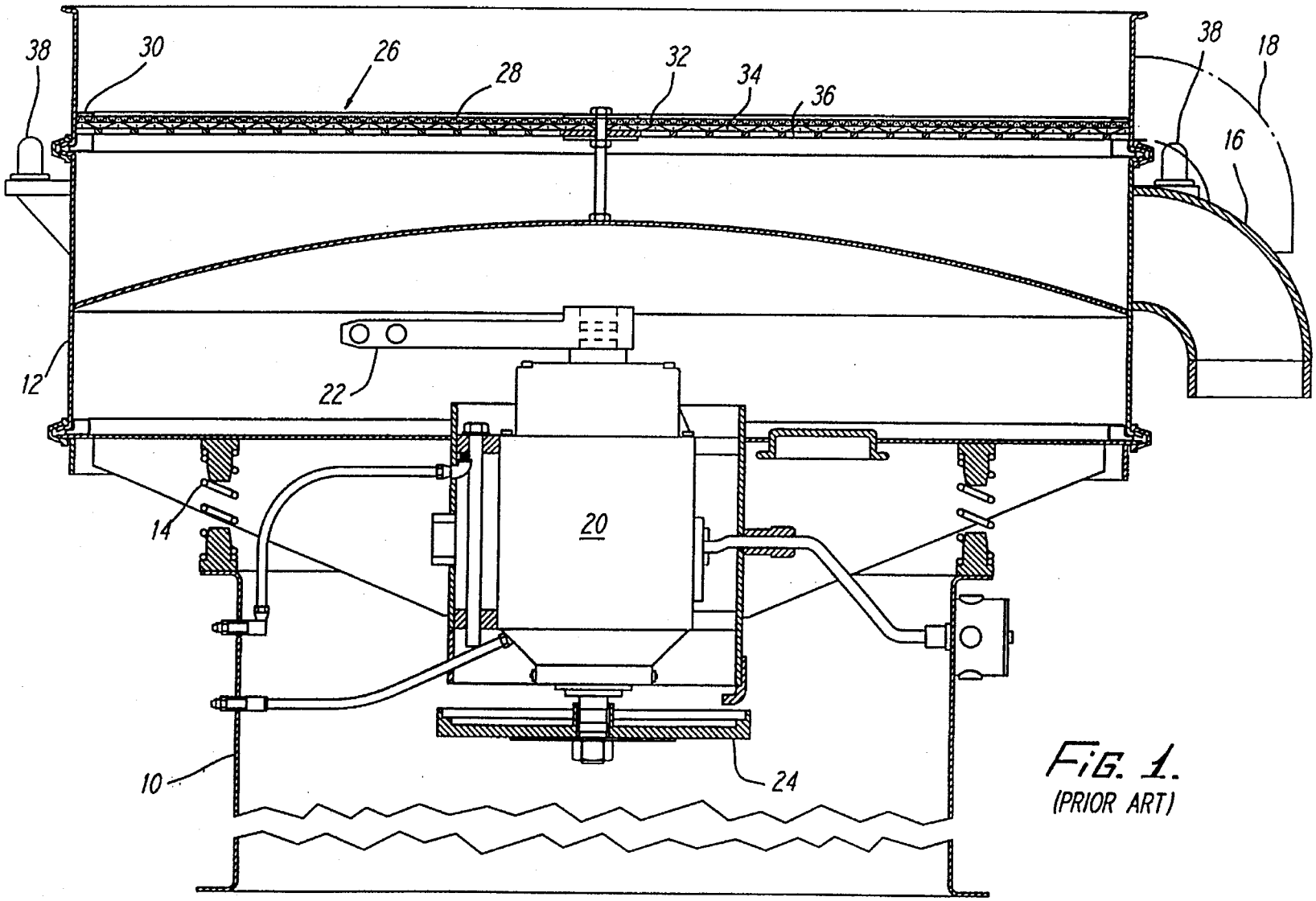
FIG. 1. (PRIOR ART)
FIG. 1 is a prior art cross-sectional elevation of a vibratory separator employing high frequency drives.
Figure 2:
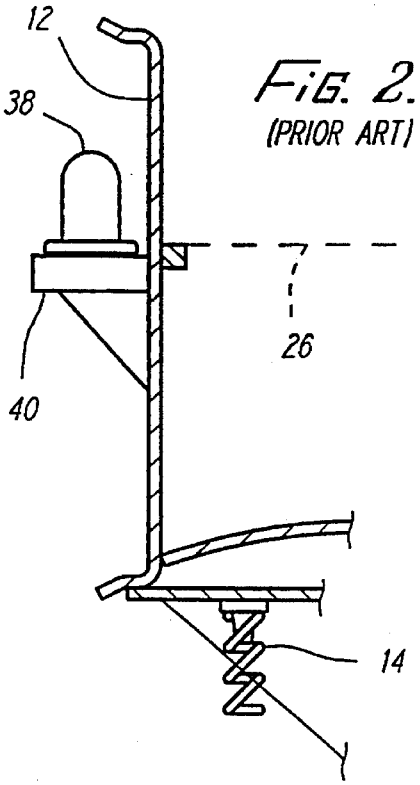
FIG. 2. (PRIOR ART)
FIG. 2 is a prior art cross-sectional detail of a separator illustrating a first mounting of a high frequency drive.
Figure 3:
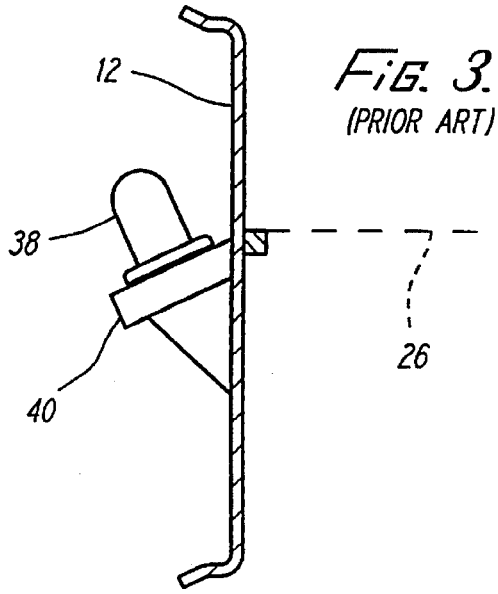
FIG. 3. (PRIOR ART)
FIG. 3 is a prior art cross-sectional detail illustrating a second mounting of a high frequency drive.
Figure 4:
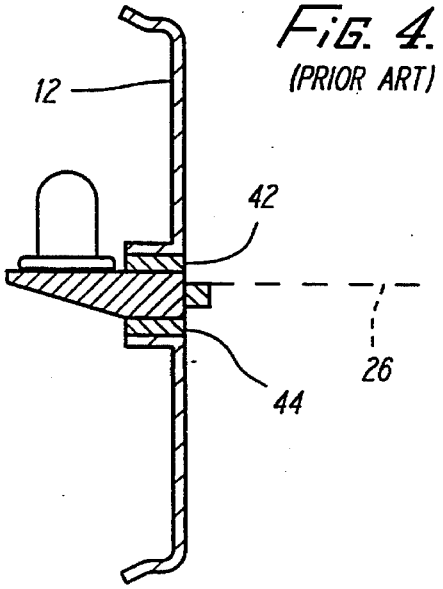
FIG. 4. (PRIOR ART)
FIG. 4 is a prior art cross-sectional detail of a second embodiment showing a first transducer mounting and an isolated frame.
Figure 5:
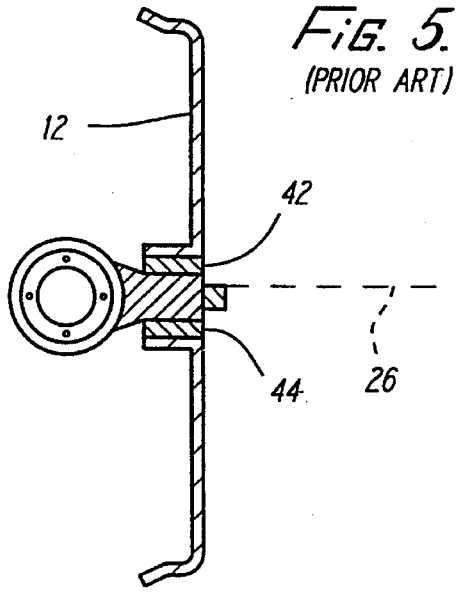
FIG. 5. (PRIOR ART)
FIG. 5 is a prior art cross-sectional detail of a second embodiment showing a second transducer mounting and an isolated frame.
Figure 6:
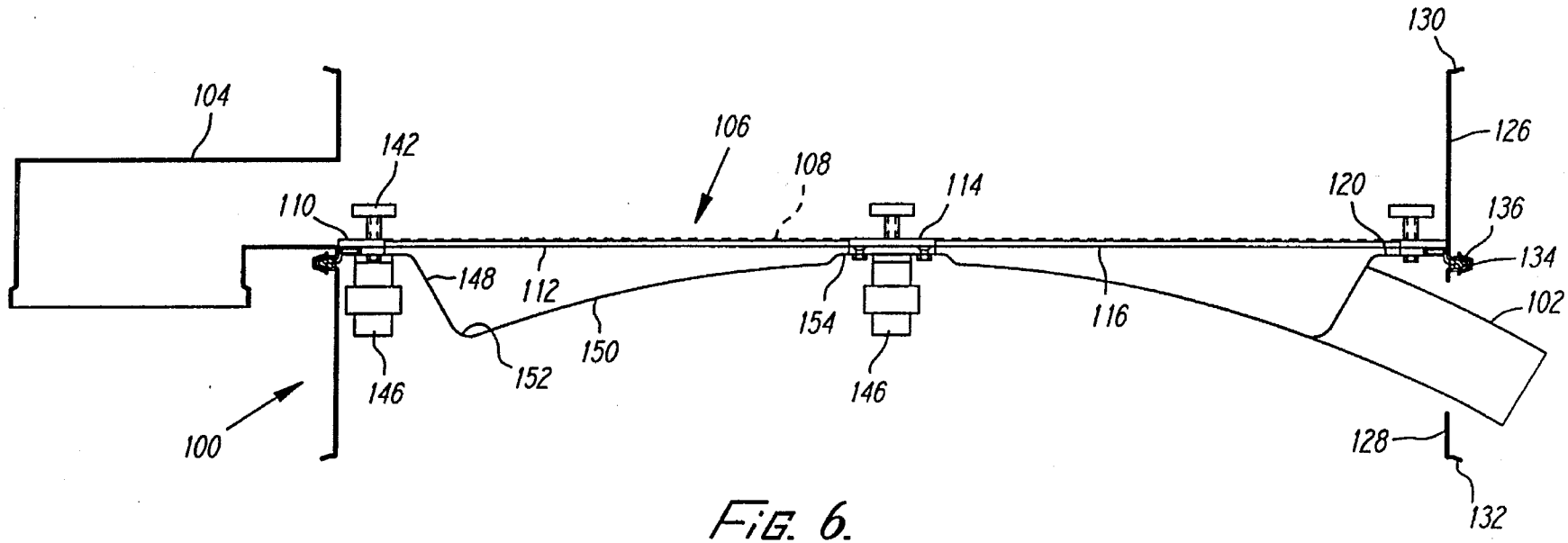
FIG. 6 is a cross-sectional elevation of the central housing detail of a first preferred embodiment of a vibratory separator employing high frequency drives.
Figure 2:
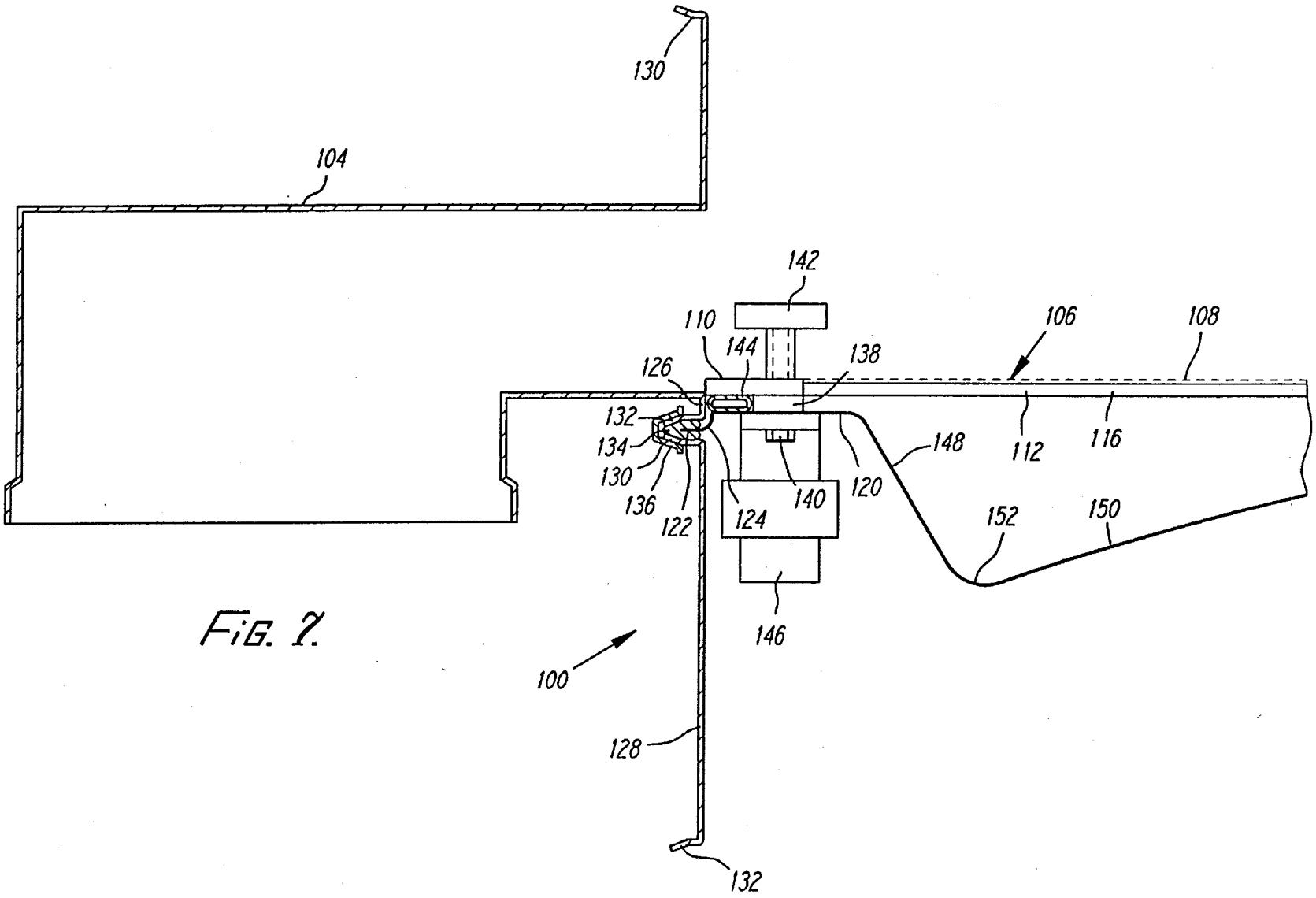
Figure 8:
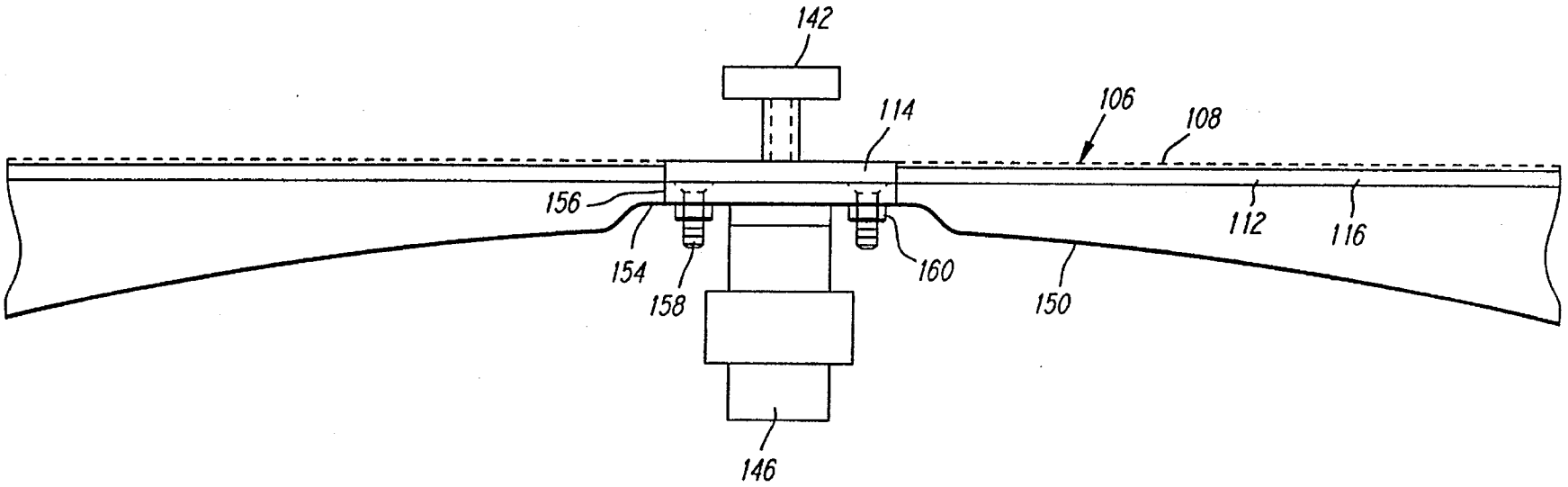
FIG. 8 is a detail of the middle portion of FIG. 6.
Figure 9:
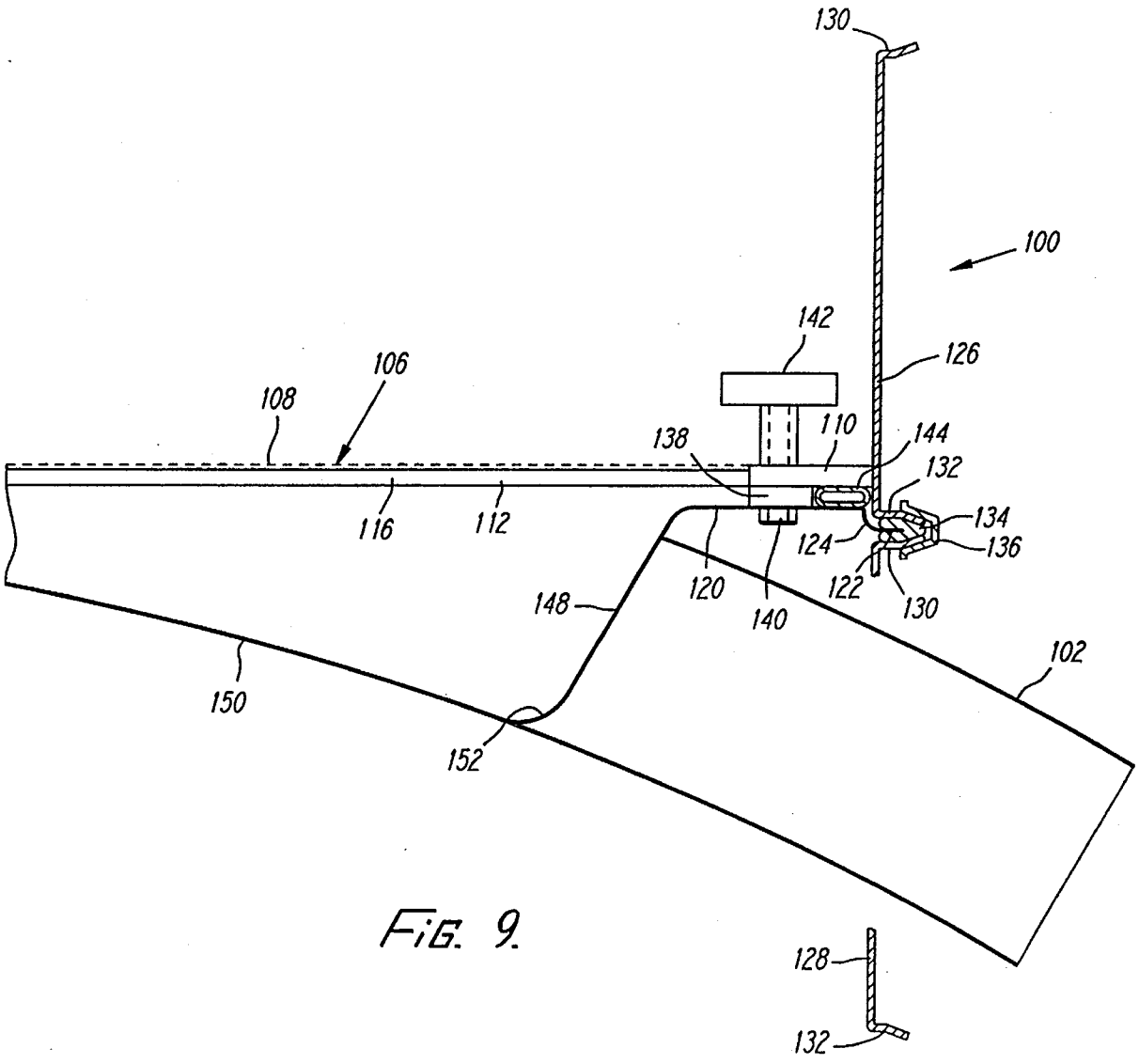
FIG. 9 is a detail of the right portion of FIG. 6.

FIG. 6 illustrates the center portion of a vibratory screen separator. The separator is understood to include the same base 10 resiliently mounting a separator housing by means of springs 14 as illustrated in FIG. 1. Also as illustrated in FIG. 1, this embodiment contemplates a low frequency vibratory drive 20 rigidly fixed to the separator housing. The drive 20 includes upper and lower eccentric weights 22 and 24 to generate a vibratory motion when rotatably driven. A speed range of 3 Hz to 60 Hz is now considered most effective depending on the application. A separator housing 100 is presented in this embodiment as cylindrical, open at the top to receive material input and having discharge ports 102 and 104 for the screened material and the oversize material, respectively.

Figure 10:
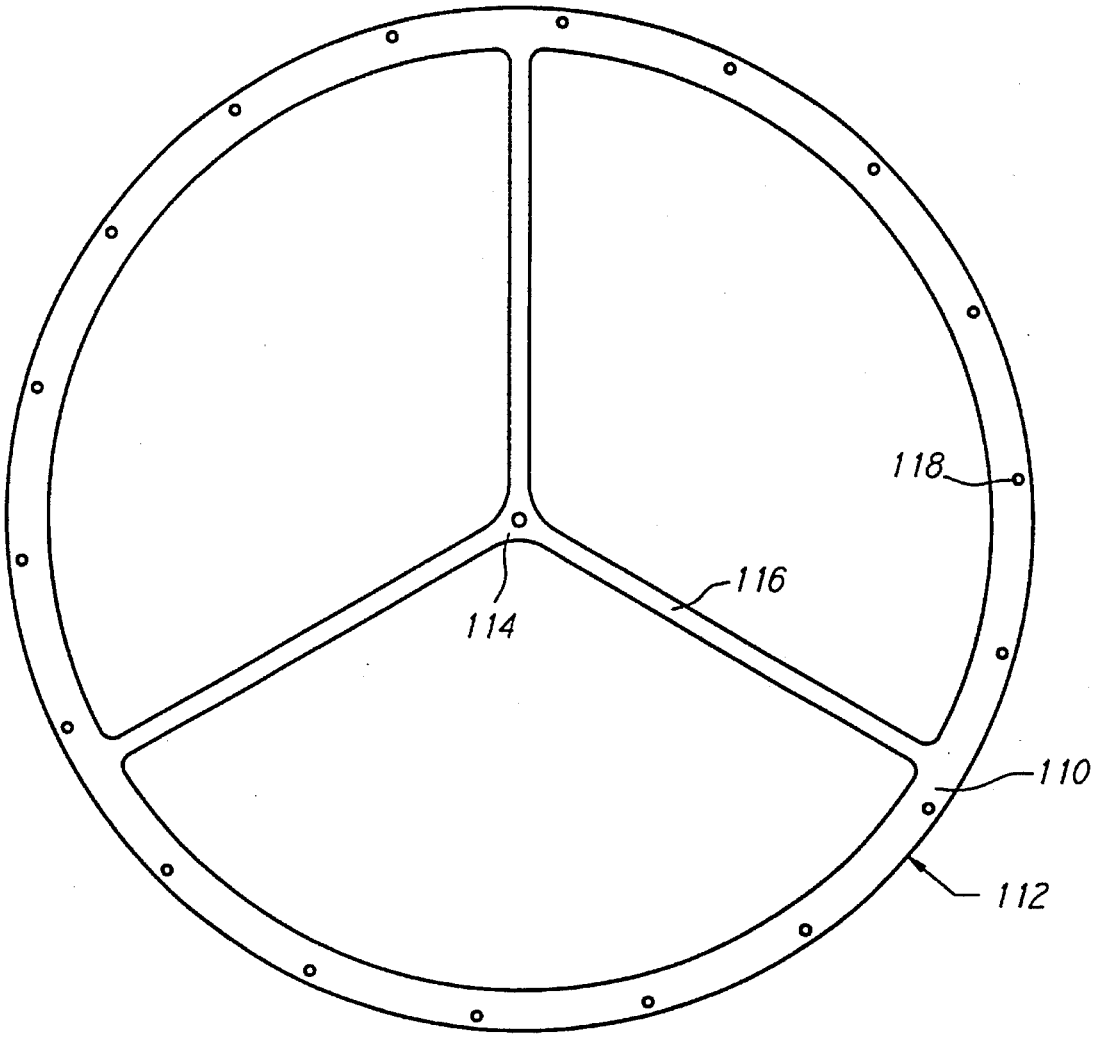
FIG. 10 is a plan view of a screen frame for use in the first embodiment.

A screen 106 extends across the separator housing 100 such that material input above the screen 106 must either pass through the screen or through the oversize discharge port 104. The screen 106 includes a screening element 108 stretched in tension uniformly by a screen frame 110. The screening element 108 may be a taut fine mesh screen cloth of a desired mesh size with or without an underlying frame or a composite of a fine mesh screen cloth of a desired size with a stiffer porous sheet, most conveniently a perforated plate. With the composite, diffusion bonding may be employed across the full area of the screening element 108. Such bonded screening elements are commercially available. The embodiment of FIG. 6 contemplates a taut screen with an underlying frame 112. The frame 112 is illustrated in FIG. 10. The frame 112 includes the outer screen frame 110, an inner hub 114 and spokes 116. Holes 118 in the frame 110, mutually spaced at 20°, and in the hub 114 provide attachment as will be discussed. The screen element is bonded or welded to the frame.

Underlying the screen 106 is a mounting ring 120, flexible in bending to high frequency vibration. The mounting ring 120 is circular and flat and is positioned adjacent to and supports the under surface of the peripheral screen frame 110. A mounting flange 122 extends outwardly from the mounting ring 120. The mounting flange 122 transitions from the mounting ring 120 through an outer, circular rim 124 which extends downwardly. The rim 124 provides strength and rigidity to the mounting flange and elevates the mounting ring 120 away from the joint in the separator housing 100.

The separator housing 100 is shown in this embodiment to be in two sections 126 and 128. Both sections 126 and 128 have attachment flanges top 130 and bottom 132. The bottom flange 132 of the upper section 126 and the top flange 130 of the lower section 128 are arranged to receive a gasket 134 of resilient elastomeric material. A clamp band 136 conventionally acts as a closure and clamp extending fully about the housing 100. When drawn tight, the clamp band 136 compresses the flanges 132 and 130 on the gasket 134. The gasket 134 acts as a resilient mounting for the mounting flange 122 fully about the housing 100. In this way, the low frequency vibrations can be transmitted through the housing 100 to the mounting ring 120 for driving the screen 106 with vibratory motion. At the same time, the resilient material of the gasket 134 helps in isolating the high frequency vibrations induced internally of the separator housing 100.

The mounting ring 120 includes a thick ring 138 positioned on top and bonded to a central portion of the essentially flat mounting ring 120. This thick ring 138 is primarily provided for backing of the mounting ring 120 for bolting the assembly together. To avoid interference with the high frequency flexure of the mounting ring 120, the thick ring 138 is narrow and does not extend fully across the mounting ring 120. Holes in the same pattern as the holes 118 in the frame 112 illustrated in FIG. 10 are provided through the mounting ring 120 and the thick ring 138. The screen frame 110 forming the outer periphery of the underlying plate 112 is positioned upon the thick ring 138 and held in place by bolts 140 positioned upwardly through the mounting ring 120 and the thick ring 138 which cooperate with hold downs 142 tightened against the screen frame 110. The hold downs 142 include handles allowing for manual tightening and untightening. Adjacent the thick ring 138, a space is provided for a flexible sealing ring 144 to keep material from collecting in the assembly and not progressing to the discharge port 102.

Retained by some of the bolts 140 beneath the mounting ring 120 so as to be fixed rigidly to the screen frame 110 are magnetostrictive ultrasonic transducers 146 to provide high frequency drives in the 20,000 to 40,000 Hz range. The mounting ring 120 acts as a bracket for this rigid mounting of the transducers 146. Three or more transducers 146 are contemplated which are located equiangularly about the mounting ring 120. By using more than one or two, a complex if not chaotic vibration pattern is induced in the screen 106. Four such transducers 146 are preferred. Additionally, a further transducer 146 may be located in the center associated with the hub 114 of the screen 106. The power contemplated for the transducers 146 is 200 watts each. They typically would run at 20,000 to 40,000 Hz. This arrangement could be employed on a separator having a diameter of 48 inches. More or less power and more transducers 146 may be employed depending on the inertia of the system and of the system with material being screened. Power in the range of 10 to 200 watts per square foot of screen is understood to be effective for the high frequency drive or drives 146.

The transducers 146 are preferred to be aligned relative to the mounting ring 120 such that the induced high frequency vibration induced is normal to the surface of the mounting ring 120. The mounting ring 120 is a thin-walled annular sheet. This allows flexure in bending of the ring 120 to avoid damping or redirected distribution of the energy away from the screen 106. Even so, the outside rim 124 provides strength outwardly of the ring 120 for the mounting function. Of course the width of the ring 120 may vary as well as the profile to get the proper strength and isolation response needed.

Inwardly of the ring portion of the mounting ring 120, an inner rim 148 may be formed which extends downwardly and inwardly. As with the outer rim 124, the inner rim 148 may provide rigidity away from the transducers 146. Inwardly of the rim 148 is a collection dome 150. This dome 150 is arranged to receive screened material and distribute that material outwardly. A trough 152 is defined between the outer periphery of the dome 150 and the inner rim 148. The trough 152 collects screened material from the dome and directs it to the screened material discharge port 102. At the center of the dome 150, an attachment section 154 may be provided to accept an attachment plate 156 shown to be attached by bolts 158 and nuts 160. This plate 156 with the attachment section 154 supports a centrally mounted transducer 146. The attachment plate 156 may receive a hub which may be a separate piece apart from the screen frame 110 or be the hub 114 of the underlying frame 112 when employed. One or more hold downs 142 would operate to retain the attachment plate 156 rigidly fixed to the screen 106.

A thin sheet forms the formed wall defining the attachment section 154, the dome 150, the trough 152, the inner rim 148, the mounting ring 120, the outer rim 124 and the mounting flange 122. These elements may be fabricated from an 18 gauge stainless steel thin-walled sheet, 0.048" before forming. An aluminum sheet of similar thickness, 0.040" before forming, is also contemplated. A spinning process is used to form the sheet into the several component shapes which together form a membrane, or formed wall, extending across the separator housing 100. In addition to the functions of each section, the formed wall acts to separate both the low frequency drive 20 and the high frequency drives 146 from the screening operation. In this way protection is afforded to the drives.

The transducers 146 can become excessively hot if kept in an enclosed space. Consequently, a fan may be associated with the low frequency drive 20 to insure appropriate circulation.

Figure 11:
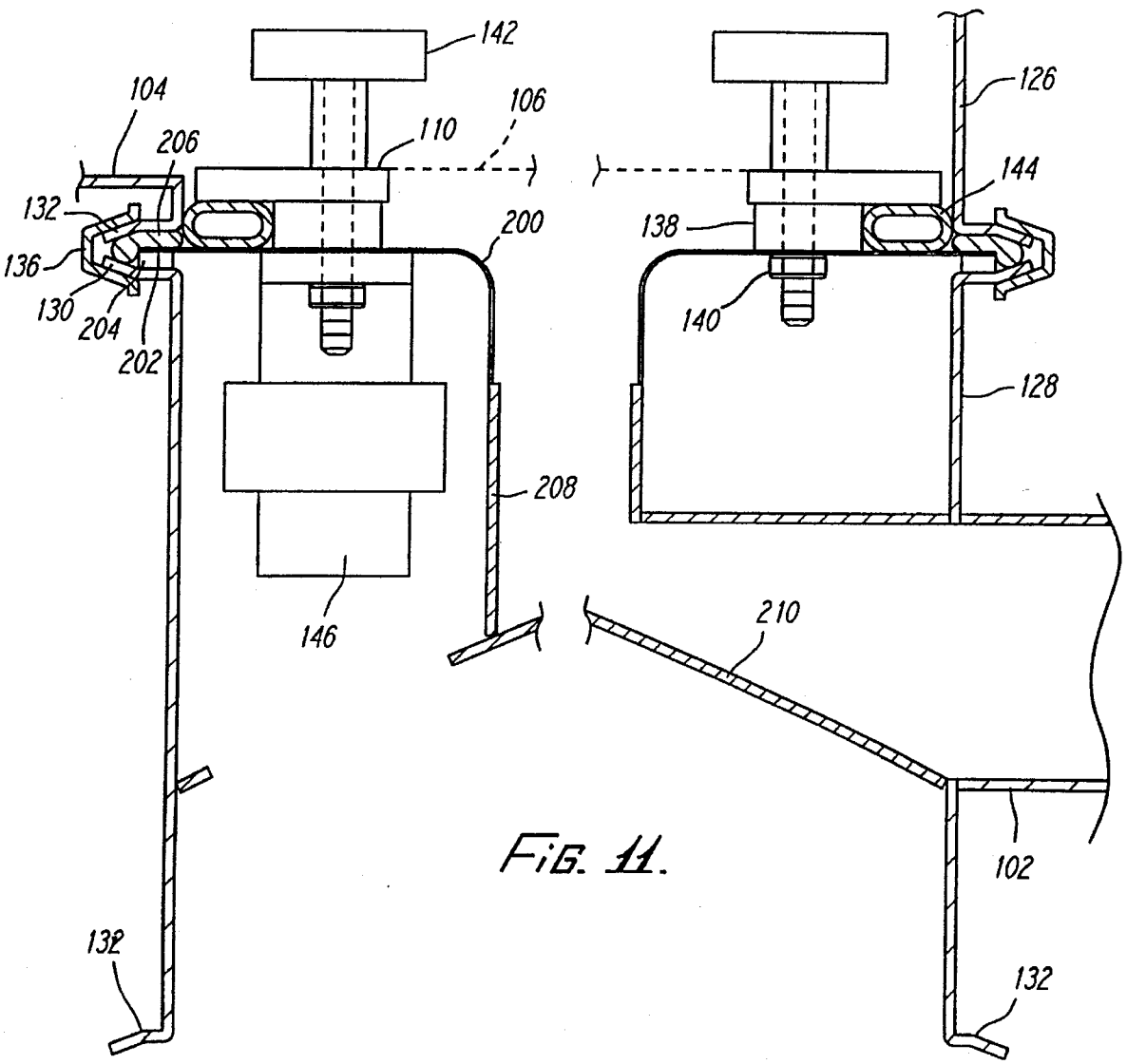
FIG. 11 is a cross-sectional elevation of the central housing detail of a second preferred embodiment of a vibratory separator employing high frequency drives.

A further embodiment is illustrated in FIG. 11. Common reference numbers to those used with the previous embodiments reflect substantially identical or equivalent components. A mounting ring 200 is again used to support the screen 106. The ring 200 supports a thick ring 138 with the screen frame 110 held rigidly relative to the ultrasonic drives 146 by hold downs 142 and fasteners 140. The ring 200 extends to a mounting flange 202 which extends outwardly. A solid ring 204 may be welded to both the top attachment flange 130 of the lower section 128 and to the mounting flange 202. A gasket 206 again provides sealing at the joint. At the inner end of the ring 200, an inner rim 208 extends downwardly to be welded to a traditional collection dome 210.

Figure 12:
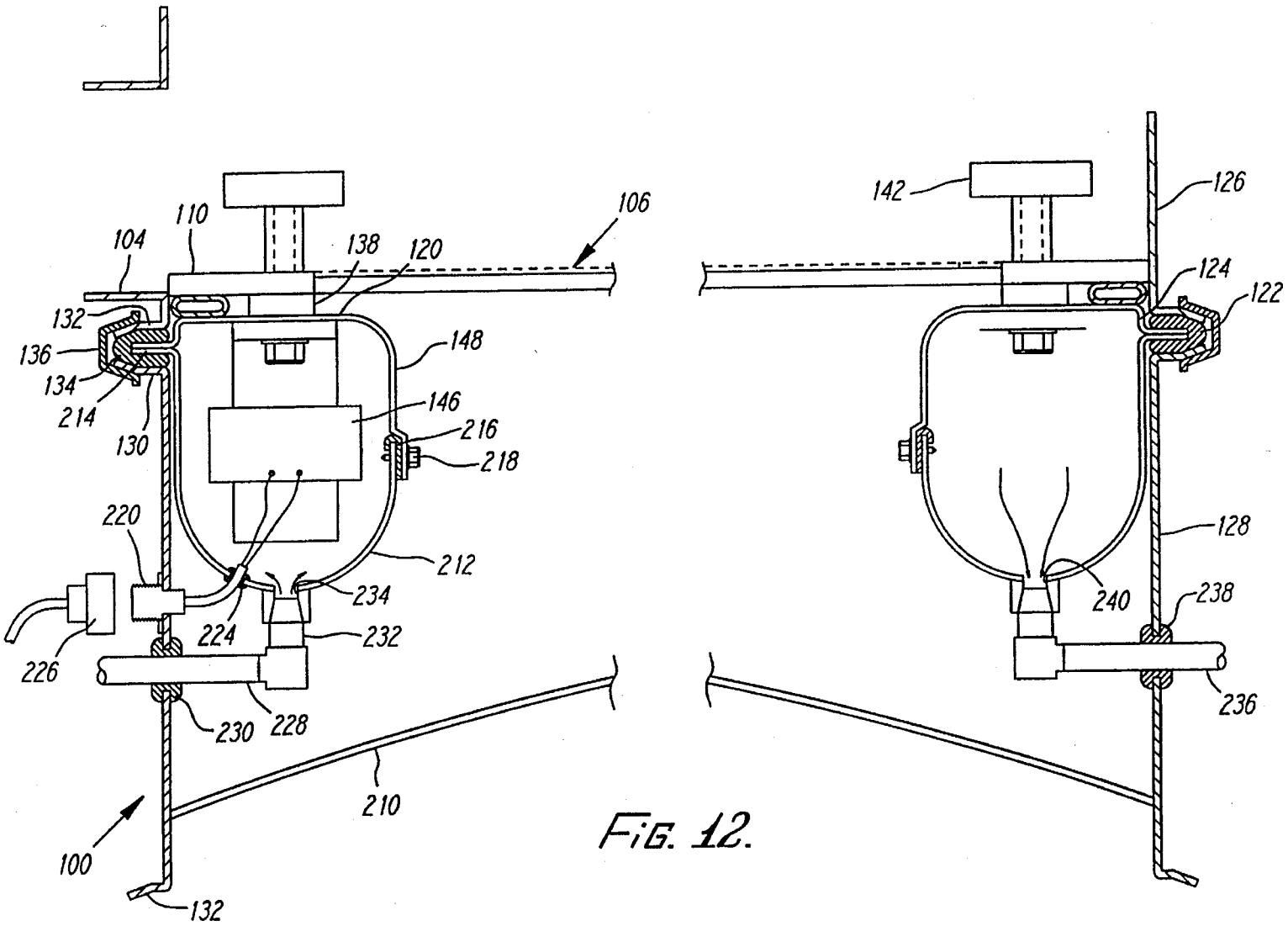
FIG. 12 is a cross-sectional elevation of a first detail of a third preferred embodiment of a vibratory separator.

Turning lastly to the embodiment of FIG. 12, again common reference numbers to those used with the previous embodiments reflect substantially identical or equivalent components. The embodiment illustrated in FIG. 12 is designed for compatibility with existing screening systems. The housing 100 is again shown to be in two sections, 126 and 128. The sections have attachment flanges top 130 and bottom 132. A collection dome 210 is welded in place within the lower housing section 128 and leads to a conventional discharge port (not shown in FIG. 12) for the strain material and a discharge port 104 for the oversize material. To hold the housing sections 126 and 128 together, a gasket material 134 is positioned between the flanges 130 and 132 and held with a clamp band 136. This structure of the housing, including the sections 126 and 128, the collection dome 210 and the mechanism for clamping the sections together including the clamp band 136, is conventional. Thus, this embodiment of FIG. 12 provides a retrofit design.

A number of elements are also substantially identical with the embodiment of FIG. 11. The mounting ring 120 along with the mounting flange 122 and circular rim 124 are substantially the same. The screen 106, the tiedowns 142 and the other elements supported by the mounting ring 120 are also shown to be substantially the same. Additionally, the ultrasonic drives 146 also compare to those of the embodiment of FIG. 11.

A wall of formed sheet defined by the mounting flange 122, outer rim 124, mounting ring 120 and inner rim 148 bridges over the ultrasonic drives 146, extending between the ultrasonic drives 146 and the screen 106. To complete an annular enclosure, an annular channel 212 extends from the inner rim 148 to the mounting flange 122. A separate mounting flange 214 is presented on the annular channel 212 which mates with the mounting flange 122 and is held within the gasket 134. At the intersection of the inner rim 148 and the annular channel 212, a gasket 216 is positioned in the part line and fasteners 218 hold the elements together.

To further retrofit the existing screening structure, a plug connection 220 is fitted to the side wall of the housing portion 128 and extends therethrough with lead wires extending to the drive 146. A grommet 224 seals the entry of the lead wires to the ultrasonic drive 146. A power connector 226 is shown to couple with the plug connector 220 for delivery of power to each of the ultrasonic transducers.

A cooling system is also illustrated in FIG. 12. As noted above, the ultrasonic drives do generate significant heat. A inlet pipe 228 is shown extending through the sidewall of the housing portion 128 with a suitable grommet 230. A coupling 232 is made with a hole 234 in the annular channel 212. A source of compressed air is coupled with the inlet pipe 228 so as to direct air through the hole 234 toward the ultrasonic drives 146. One such air delivery system is preferably associated with each ultrasonic drive. A vent pipe 236 extending through a grommet 238 is coupled with the annular channel 212 at a hole 240. The hole 240 is located at the lowest part of the annular channel 212 so as to vent any accumulated moisture or the like.

In vibration theory, one might attempt to analyze vibration of a thin planar object as either a membrane where the tension forces in the plane of the object dominate or as a plate where resistance to bending, or stiffness, of the planar object dominates. The propagation constant or wavenumber for membrane vibration is:

$$K_{membrane} = \frac{2\pi}{\lambda} = \frac{\omega}{C} = \omega\sqrt{\frac{\rho}{T}}$$

where $\lambda$=wavelength

ω=frequency radians per second

C=velocity of waves

ρ=mass density

T=static tension

The wavenumber for a plate is:

$$k_{plate} = \frac{\omega}{C} = \sqrt{\omega}\left[\frac{\rho}{D}\right]^{1/4}$$

where $$D = \text{plate bending stiffness} = \frac{Eh^3}{12(1-\nu^2)}$$

E=Young's Modulus h=thickness of the plate

ν=Poisson's ratio.

To determine appropriate screen characteristics, the relative effects of stiffness and tension may be determined by calculating the ratio of the two wavenumbers:

$$\text{RATIO} = \frac{k_{membrane}}{k_{plate}} = \sqrt{\omega}\,\rho\,\frac{1}{4}\sqrt{\frac{\sqrt{D}}{T}}$$

When this ratio is much less than unity, tension dominates and membrane theory applies. When the ratio is much greater than unity, stiffness dominates; therefore, the screen behaves in a plate-like manner. Using this formula, screens exhibiting a ratio in excess of unity tend to act plate-like while screens exhibiting a ratio of less than unity tend to act membrane like. In estimating plate bending stiffness, the standard Poisson's ratio for stainless steel may be reduced to 0.2 to account for the relief provided by the holes in the screen. Calculations of unsupported and supported screens at a vibration frequency of 20,000 Hz establish the following values:

| Screen | Mass Density, ρ, g/m³ | Plate Stiffness, D, newton-mm | Wavenumber Ratio (Eq. 4) |
|---|---|---|---|
| 200 mesh | 298 | 0.38 | 0.67 |
| 325 mesh | 209 | 0.19 | 0.51 |
| 200 mesh bonded | 696 | 13.3 | 2.02 |
| 325 mesh bonded | 611 | 11.6 | 1.88 |

In running a test unit, using an 18 inch diameter 200 mesh (74 micron) diffusion bonded screen having the properties as indicated in the table, excitation frequency was set at approximately 20,000 Hz. One hundred watts of power was employed which appears to have been more than sufficient. Increasing the wattage did not appear to significantly increase screening efficiency. Screening efficiency may in fact increase with decreased wattage and adjustment of the vibration pattern. Effective high frequency vibration is understood to be in the range of from about 10,000 Hz to 50,000 Hz. The plate-like behavior of the screen has suggested that less tension may be required with such a configuration. Taut, fine mesh screen cloth may alternatively be employed without backing or without the frame structure of FIG. 10 as discussed above. Empirical results suggest close to double the screening efficiency of the same system without high frequency vibration.

One or more high frequency generators 146 are associated with the peripheral frame. Clearly, empirical testing as to the number of generators 146, their placement and orientation for the characteristics of each material being processed is appropriately conducted. An increased number of generators 146 provides greater flexibility and uniformity of high frequency energy coverage. However, increasing the number of generators 146 increases cost and complexity. Several types of such generators are available. It is presently believed that magnetostrictive ultrasonic transducers are preferred as they are more rugged for shop use and have a wider frequency band.

Accordingly, improved screening systems are disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A screening system comprising a resiliently mounted housing;

a low frequency vibratory drive coupled to the housing;

a screen extending across and within the housing, including a peripheral screen frame and a screen element fixed to the peripheral screen frame about the periphery of the screen element;

a mounting ring flexible in bending to high frequency vibration adjacent and supporting the under surface of the peripheral screen frame;

a mounting flange extending outwardly from the mounting ring and retained by the housing;

at least one high frequency drive held rigidly to the peripheral screen frame and positioned below the mounting ring and within the housing.

2. The screening system of claim 1 further comprising a resilient mounting between the mounting flange and the housing.

3. The screening system of claim 1, there being at least three high frequency drives held rigidly to the peripheral screen frame and positioned below the mounting ring and within the housing.

4. The screening system of claim 3, the peripheral screen frame including a central hub and spokes between the central hub and the peripheral screen frame and there being a high frequency drive held rigidly to the hub.

5. The screening system of claim 1 further comprising a rim extending inwardly and downwardly from the mounting ring and being inwardly of the at least one high frequency drive.

6. The screening system of claim 5 further comprising a dome extending inwardly from the rim, the rim and the dome defining a trough at the intersection of the rim and the dome.

7. The screening system of claim 6 further comprising a discharge port extending from the trough to outwardly of the housing.

8. The screening system of claim 6, the peripheral screen frame including a central hub and spokes between the central hub and the peripheral screen frame, the dome being fixed to the hub.

9. The screening system of claim 8, there being a high frequency drive held rigidly to the hub.

10. The screening system of claim 1, the mounting ring including a thick ring rigidly fixed to the mounting ring between the mounting ring and the under surface of the screen frame, the mounting flange extending outwardly of the thick ring.

11. The screening system of claim 10, the screen frame being held together with the thick ring and the mounting ring.

12. The screening system of claim 1, the at least one high frequency drive being aligned to induce vibration in a direction of bending of the mounting ring at the screen frame.

13. The screening system of claim 1 further comprising a wall extending between the at least one drive and the screen to isolate the at least one drive from the material processed through the screen, the wall extending from the mounting ring.

14. The screening system of claim 13, the wall being a formed sheet including the mounting ring, the mounting flange, a rim extending inwardly and downwardly from the mounting ring and a dome inwardly of the rim, the at least one drive being below the formed sheet and the screen being above the formed sheet.

15. The screening system of claim 13, the wall forming an annular enclosure with the mounting ring, the at least one high frequency drive being included within the annular enclosure.

16. The screening system of claim 15, the annular enclosure including an inlet port, a source of compressed air to the inlet port and a vent from the annular enclosure.

17. The screening system of claim 16, the vent being at the bottom of the annular housing.

18. A screening system comprising a resiliently mounted housing;

a low frequency vibratory drive coupled to the housing;

a screen extending across and within the housing, including a peripheral screen frame and a screen element fixed to the peripheral screen frame about the periphery of the screen element;

a mounting ring flexible in bending to high frequency vibration adjacent and supporting the under surface of the peripheral screen frame;

a mounting flange extending outwardly from the mounting ring and retained by the housing;

at least one high frequency drive held rigidly to the peripheral screen frame, positioned below the mounting ring and within the housing and aligned to induce vibration in a direction perpendicular to the mounting ring at the screen frame.

19. The screening system of claim 18, there being at least three high frequency drives held rigidly to the peripheral screen frame and positioned below the mounting ring and within the housing and aligned to induce vibration in a direction perpendicular to the mounting ring at the screen frame.

20. The screening system of claim 19, the peripheral screen frame including a central hub and spokes between the central hub and the peripheral screen frame and there being a high frequency drive held rigidly to the hub aligned to induce vibration in a direction perpendicular to the mounting ring at the screen frame.

21. The screening system of claim 18, the mounting ring including a thick ring rigidly fixed to the mounting ring between the mounting ring and the under surface of the screen frame, the mounting ring being substantially wider than the thick ring.

22. The screening system of claim 18 further comprising a wall extending between the at least one drive and the screen to isolate the at least one drive from the material processed through the screen, the wall extending from the mounting ring.

23. The screening system of claim 22, the wall being a formed sheet which includes the mounting ring, the mounting flange, a rim extending inwardly and downwardly from the mounting ring and a dome inwardly of the rim, the at least one drive being below the formed sheet and the screen being above the formed sheet.

24. The screening system of claim 22 further comprising a collection dome extending across the housing below the screen, the wall being a formed sheet which includes the mounting ring, the mounting flange and a rim extending downwardly from the mounting ring to meet the collection dome.

25. The screening system of claim 22, the wall being a formed sheet which includes the mounting ring, the mounting flange and a rim extending downwardly from the mounting ring and an annular channel extending from the rim to the mounting flange to form an annular enclosure with the formed sheet enclosing the at least one drive.

26. A screening system comprising a resiliently mounted housing;

a low frequency vibratory drive coupled to the housing;

a screen extending across and within the housing;

a thin, formed sheet extending across and within the housing and including a mounting ring flexible in bending to high frequency vibration adjacent and supporting the under peripheral surface of the screen, a mounting flange extending outwardly from the mounting ring, an inner rim inwardly of and extending downwardly from the mounting ring and a dome inwardly of the inner rim, the inner rim and the dome forming a trough therebetween;

high frequency drives held rigidly to the periphery of the screen and positioned below the mounting ring and within the housing.

27. The screening system of claim 26, the thin, formed sheet further including an outer rim between the mounting ring and the mounting flange and extending downwardly from the mounting ring.

28. The screening system of claim 27 further comprising a resilient mounting between the mounting flange and the housing.

29. The screening system of claim 26 further comprising a high frequency drive held rigidly to the center of the dome, the dome being attached to the center of the screen.

30. The screening system of claim 26, the screen including a peripheral screen frame and a tensioned screen element fixed to the peripheral screen frame about the periphery of the screen element, the mounting ring having a thick ring rigidly fixed to the mounting ring between the mounting ring and the under surface of the screen frame, the mounting flange extending outwardly of the thick ring, the mounting ring being held to the screen frame about the periphery of the screen frame.

31. A screening system comprising a resiliently mounted housing;

a low frequency vibratory drive coupled to the housing;

a screen extending across and within the housing including a peripheral screen frame and a tensioned screen element fixed to the peripheral screen frame about the periphery of the screen element;

a thin, formed sheet extending across and within the housing and including a mounting ring flexible in bending to high frequency vibration adjacent and supporting the under surface of the peripheral screen frame, a mounting flange extending outwardly from the mounting ring, an inner rim inwardly of and extending downwardly from the mounting ring, a dome inwardly of the inner rim, the inner rim and the dome forming a trough therebetween, an outer rim between the mounting ring and the mounting flange and extending downwardly from the mounting ring;

high frequency drives held rigidly to the peripheral screen frame and positioned below the mounting ring and within the housing.

32. The screening system of claim 31 further comprising a resilient mounting between the mounting flange and the housing.

33. The screening system of claim 31 further comprising a high frequency drive held rigidly to the center of the dome, the dome being attached to the center of the screen.

34. The screening system of claim 31, the mounting ring having a thick ring rigidly fixed to the mounting ring between the mounting ring and the under surface of the screen frame, the mounting flange extending outwardly of the thick ring, the mounting ring being held to the screen frame about the periphery of the screen frame.

35. A screening system comprising a resiliently mounted housing;

a low frequency vibratory drive coupled to the housing;

a screen extending across and within the housing, including a peripheral screen frame, a central hub and spokes between the central hub and the peripheral screen frame and a tensioned screen element fixed to the peripheral screen frame about the periphery of the screen element;

a thin, formed sheet extending across and within the housing and including a mounting ring flexible in bending to high frequency vibration adjacent and supporting the under surface of the peripheral screen frame, a mounting flange extending outwardly from the mounting ring, an inner rim inwardly of and extending downwardly from the mounting ring, a dome inwardly of the inner rim, the inner rim and the dome forming a trough therebetween, an outer rim between the mounting ring and the mounting flange and extending downwardly from the mounting ring;

high frequency drives positioned below the thin, formed sheet within the housing, a plurality of the high frequency drives being held rigidly to the peripheral screen frame and at least one of the high frequency drives being held rigidly to the hub.

36. The screening system of claim 35 further comprising a resilient mounting between the mounting flange and the housing.

37. The screening system of claim 35, the mounting ring having a thick ring rigidly fixed to the mounting ring between the mounting ring and the under surface of the screen frame, the mounting flange extending outwardly of the thick ring, the mounting ring being held to the screen frame about the periphery of the screen frame.

* * * * *